US006118092A

United States Patent [19]

Hayashi

[11] Patent Number: 6,118,092

[45] Date of Patent: Sep. 12, 2000

[54] KEY SWITCH FOR KEYBOARD

[75] Inventor: Kazutoshi Hayashi, Tokyo, Japan

[73] Assignee: Fujitsu Takamisawa Component Limited, Tokyo, Japan

[21] Appl. No.: 09/400,852

[22] Filed: Sep. 21, 1999

[30] Foreign Application Priority Data

Sep. 22, 1998 [JP] Japan ..... 10-268551

[51] Int. Cl.[7] ..... H01H 13/70

[52] U.S. Cl. ..... 200/344

[58] Field of Search ..... 200/341–344, 200/512–517

[56] References Cited

U.S. PATENT DOCUMENTS 5,779,030 7/1998 Ikegami et al. ..... 200/344

5,828,015 10/1998 Coulon ..... 200/5 A

*Primary Examiner*—Michael L. Gellner

*Assistant Examiner*—Nhung Nguyen

*Attorney, Agent, or Firm*—Staas & Halsey LLP

[57] ABSTRACT

A key switch comprising a base, a key top arranged above the base, a pair of link members interconnected with each other to support the key top above the base and to direct the key top in a vertical direction, a biasing member for elastically urging the key top vertically away from the base, and a switching mechanism for selectively opening and closing an electric circuit in connection with a vertical movement of the key top. Each of the link members includes opposed first and second side walls, slide portions formed at one ends of the first and second side walls to be slidably engaged with the base, pivot portions formed at halfway points of the first and second side walls to be pivotably engaged with the key top to define a pivot axis of each link member, a joint shaft provided at another end of the first side wall to project from the first side wall, and a joint slot provided at another end of the second side wall to permit the joint shaft to be slidably and pivotably received in the joint slot of counterpart link member.

10 Claims, 9 Drawing Sheets

KEY SWITCH FOR KEYBOARD

BACKGROUND OF THE INVENTION

1. Field of the Invention

The present invention relates generally to a switch mechanism for a key-entry use and, more particularly, to a key-entry switch (hereinafter referred to as a key switch) preferably used for relatively thin keyboards incorporated as input terminals in data processing equipment such as personal computers or word processors.

2. Description of the Related Art

When data processing equipments, such as personal computers or word processors, etc., are required to be downsized for portable use, it is also required for keyboards incorporated therein to have a reduced height or thickness. However, as a solution for reducing the thickness of the keyboard, if the stroke of each of plural key switches provided in the keyboard is reduced, proper key-entry operations may be made difficult. Accordingly, it has been desired to provide a key switch in which the height of the keyboard can be reduced while maintaining the stroke of the key switch at a predetermined distance to ensure good and stable operational properties thereof.

FIGS. 1, 2A and 2B show an example of a conventional key switch for use in a relatively thin keyboard. As shown in FIG. 1, the conventional key switch includes a key top 2 adapted to be keyed or pushed down by an operator's finger, a base 3 disposed beneath the key top 2, a pair of gear-link members 1 for supporting the key top 2 above the base 3 and directing it in the vertical or up-and-down direction, a sheet-like switch (hereinafter referred to as a membrane switch) 5 arranged beneath the base 3, an elastic actuating member (not shown) located between the key top 2 and the membrane switch 5 so as to open and close the membrane switch 5 corresponding to the vertical or up-and-down movement of the key top 2, and a support panel 4 disposed beneath the membrane switch 5 to hold it between the base 3 and the support panel 4.

The pair of gear-link members 1 are assembled into a generally reverse V-shape in a side view and meshed with each other at the toothed ends 13 thereof. Each of the gear-link members 1 includes a sliding bar 11 and a pair of arms 12 joined perpendicularly to the bar 11 near the opposed ends of the latter. Each arm 12 is provided at the distal or toothed end 13 thereof with at least one tooth 14 which radially projects from the circumferential edge of the toothed end 13. Slide shafts 16 are formed at the opposed ends of the bar 11, and pivot shafts 15 are formed near the toothed ends 13 of the arms 12 to project on the same sides as, and in parallel to, the slide shafts 16. The gear-link members 1 are pivotably interconnected with each other by intermeshings between one tooth 14 of the first arms 12 of respective gear-link members 1 and two teeth 14 of the second arms 12 of respective gear-link members 1.

The key top 2 is provided at an inner surface thereof with a pair of pivot supports 22, each of which includes two bearing holes 21. The pivot supports 22 are located in such a manner that the respective two bearing holes 21 are opposite to each other. The pivot shafts 15 formed near the toothed ends 13 of the arms 12 of each gear-link member 1 are pivotably fitted or received in the bearing holes 21 of the respective pivot supports 22 (see FIG. 2A).

The base 3 is provided with a center opening 31 into which the pair of gear-link members 1 can be inserted, and two pairs of slide supports 32 arranged along two opposed inner edges defining the center opening 31 and partially projecting above the center opening 31. Each of the slide supports 32 is provided at the end thereof with a stopper 33, and defines a bearing slot between the membrane switch 5 and the slide support 32. The slide shafts 16 formed at the opposed ends of the bar 11 of each gear-link member 1 are slidably fitted or received in the bearing slots of the respective slide supports 32 (see FIG. 2A). The stopper 33 of each slide support 32 acts to prevent each slide shaft 16 falling-out from the bearing slot.

In this structure, the key top 2 is permitted to be subjected to a parallel displacement in a substantially vertical direction on the base 3, while keeping a predetermined posture of the key top 2. Also, it is possible to reduce the entire height of the key switch, while maintaining a predetermined amount of the stroke of the key switch.

The membrane switch 5 is structured from two flexible printed circuit boards 52, of which conductive patterns are arranged opposite to each other through a spacer 51. A switching element formed from a pair of conductive contacts opposed to each other through a gap is positioned beneath the key top 2.

The elastic actuating member (not shown) is a dome-like member made from a rubber material. When no external force is applied to the key top 2, the elastic actuating member supports the key top 2 and urges the latter toward an initial position vertically upwardly away from the base 3 (see FIG. 2A). During this state, the slide shafts 16 of each gear-link member 1 are biased along the bearing slots of the respective slide supports 32, and are located near the stoppers 33 of the slide supports 32.

When the key top 2 is pushed downward by a key-entry operation, the elastic actuating member is elastically deformed while exerting biasing or elastic restoring force to the key top 2 in an upward direction. During this operation, the gear-link members 1 are pivoted in an interlocked manner, and the slide shafts 16 of each gear-link member 1 are shifted in the bearing slots of the slide supports 32 to enlarge the distance from the slide shafts 16 of the counterpart gear-link member 1. Then, the interior surface of the dome upper end of the elastic actuating member pushes the outer surface of the upper flexible printed circuit board 52, so as to close or turn-on the membrane switch 5.

When downward pushing force applied to the key top 2 is released, the elastic actuating member is elastically restored, so as to return or push-up the key top 2 to the initial position and to open or turn-off the membrane switch 5. During this operation, the gear-link members 1 are pivoted in a reverse direction in an interlocked manner, and the slide shafts 16 of each gear-link member 1 are shifted in the bearing slots of the slide supports 32 to reduce the distance from the slide shafts 16 of the counterpart gear-link member 1.

In the above-mentioned conventional key switch including the gear-link members, it is generally required to provide the toothed ends of the arms of each gear-link member with a dimension sufficient to enable a smooth rotation under the intermeshed condition where at least one tooth of each toothed end are intermeshed with the counterpart at least one tooth. This dimensional requirement of the gear-link member may hamper the reduction of the height or thickness of the keyboard.

Also, it is generally required to highly precisely form the at least one tooth of the toothed end, in order to establish the smooth rotation under the intermeshed condition of the gear-link members. However, when the gear-link member is miniaturized to a certain degree, it is made difficult to precisely form the at least one tooth of the toothed end. As a result, the operational properties of the key switch may be deteriorated, and the production cost for the keyboard may be increased.

SUMMARY OF THE INVENTION

It is therefore an object of the present invention to provide a key switch, for a key-entry operation, which can reduce the dimensions of each of a pair of link members used therein, while maintaining the smooth rotation of interconnected link members, so as to reduce the height of the key switch.

It is another object of the present invention to provide a key switch, for a key-entry operation, which can serve to significantly reduce the height of a keyboard while maintaining the stroke of the key switch at a predetermined distance to ensure good and stable operational properties thereof.

In accordance with the present invention, there is provided a key switch comprising a base; a key top arranged above the base; a pair of link members interconnected with each other, each of the link members including opposed first and second side walls, slide portions formed at one ends of the first and second side walls to be slidably engaged with the base, pivot portions formed at halfway points of the first and second side walls to be pivotably engaged with the key top to define a pivot axis of each link member, a joint shaft provided at another end of the first side wall to project from the first side wall, and a joint slot provided at another end of the second side wall to permit the joint shaft to be slidably and pivotably received in the joint slot of counterpart link member, the link members acting to support the key top above the base and to direct the key top in a vertical direction; a biasing member for elastically urging the key top vertically away from the base; and a switching mechanism for selectively opening and closing an electric circuit in connection with a vertical movement of the key top.

It is preferred that the joint shaft provided to the first side wall of the each link member extends generally in parallel with the pivot axis, and the joint slot provided to the second side wall opens at a peripheral edge of the second side wall.

It is also preferred that the biasing member is a compression spring disposed between the base and at least one of the link members.

In this arrangement, the compression spring may be a plate spring securely joined to at least one of the link members at a position near the sliding portions, a free end of the plate spring being abutted to the base.

The switching mechanism may comprise a membrane switch arranged beneath the base and adjacent to the link members through an opening formed in the base, and an actuating member for pushing the membrane switch to close the electric circuit.

In this arrangement, the actuating member may be an actuating arm formed on at least one of the link members.

Alternatively, the actuating member may be a dome-shaped rubber material arranged between the membrane switch and the key top through an opening defined between interconnected link members, the dome-shaped rubber material also acting as the biasing member.

Also, the membrane switch may be provided with openings at positions where the side walls of the link members are received in the openings.

It is advantageous that each of the link members is made from a metal plate.

It is also advantageous that each of the link members is provided with a rib formed along a peripheral edge of the joint slot.

BRIEF DESCRIPTION OF THE DRAWINGS

The above and other objects, features, and advantages of the present invention will become more apparent from the following description of preferred embodiments in connection with the accompanying drawings, in which.

DESCRIPTION OF THE PREFERRED EMBODIMENT

Figure 1:
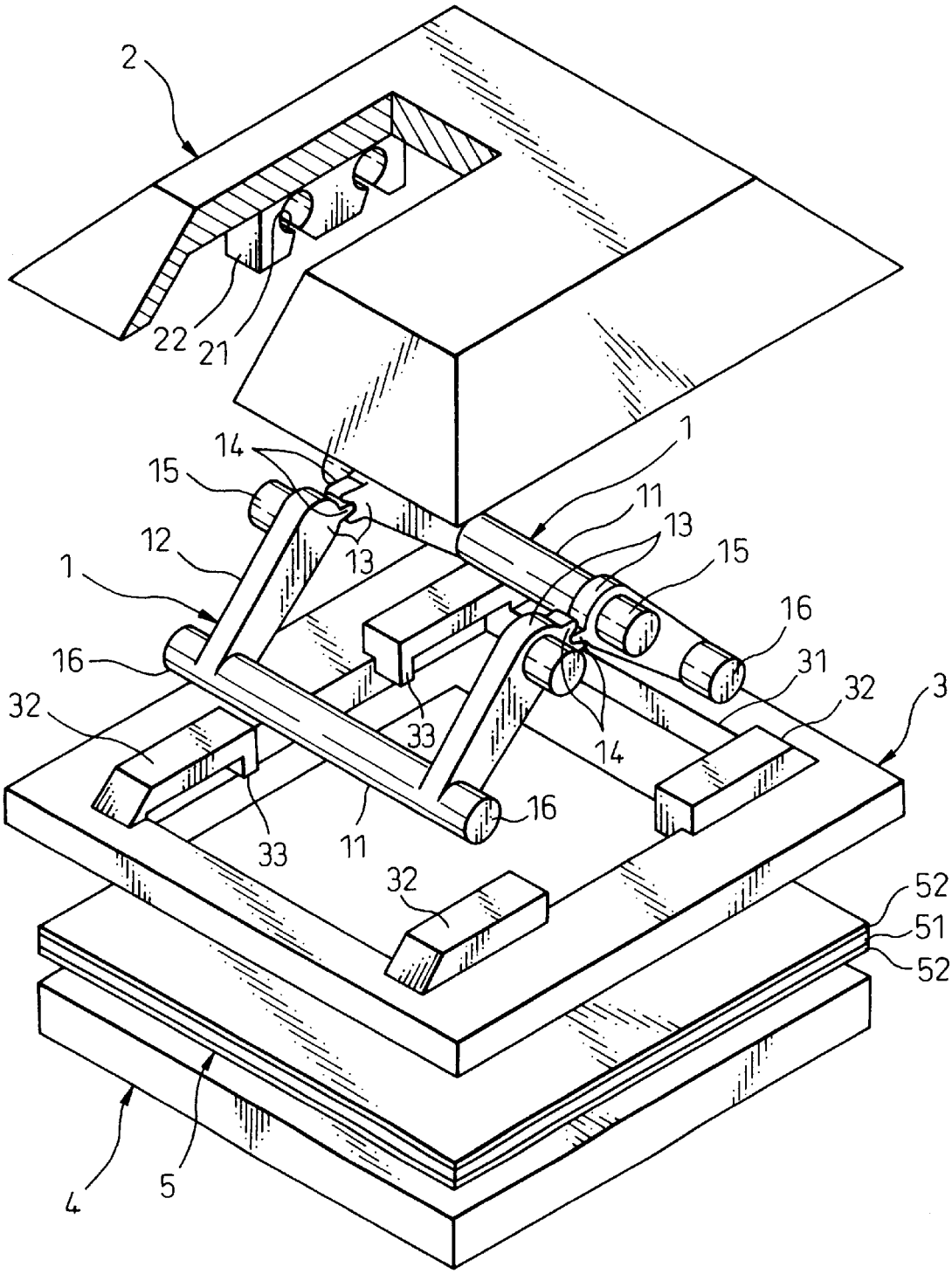
Fig. 1 PRIOR ART
FIG. 1 is a partially cut-out, exploded perspective view of a conventional key switch.
Figure 2A:
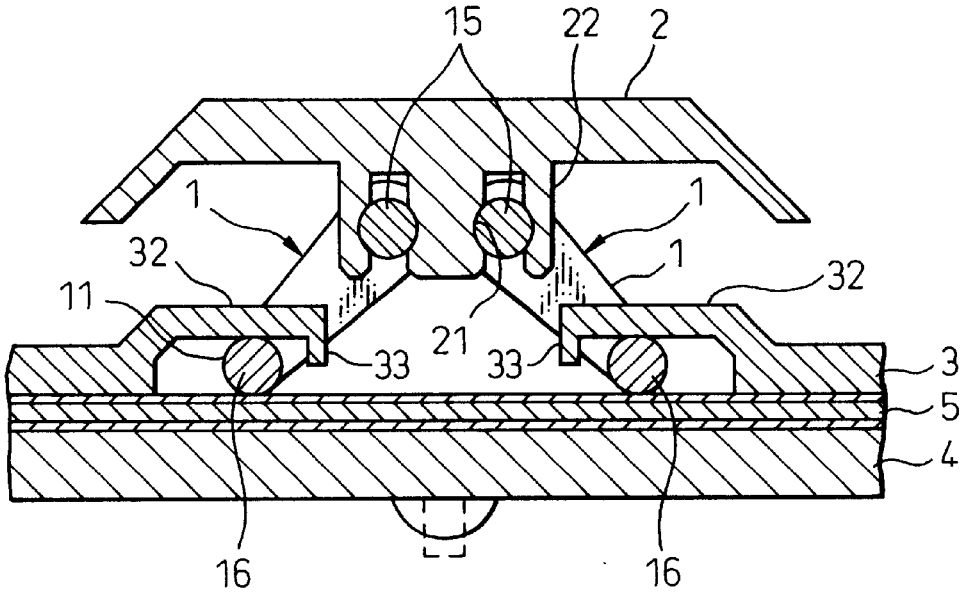
Fig. 2A PRIOR ART
FIGS. 2A and 2B are sectional views showing the key switch of FIG. 1 in assembled, non-operated and operated states, respectively.
Figure 2B:
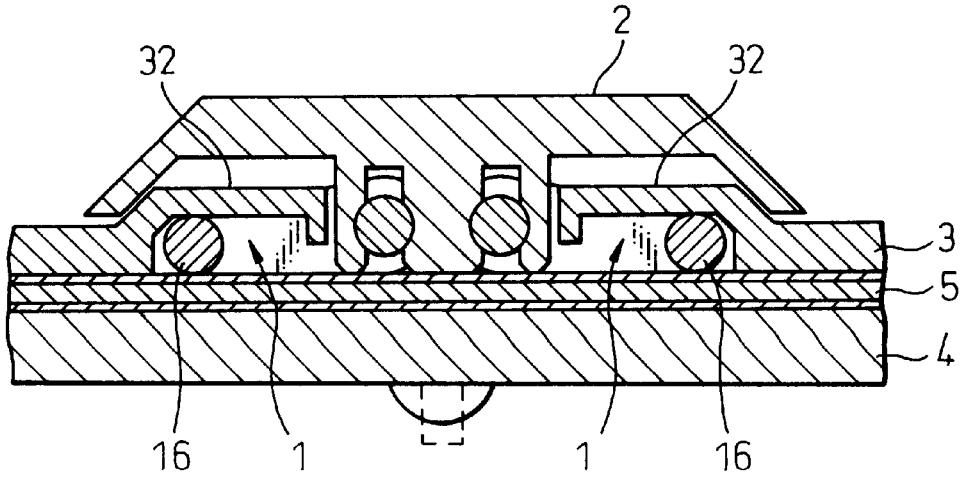
Fig. 2B PRIOR ART
Figure 3:
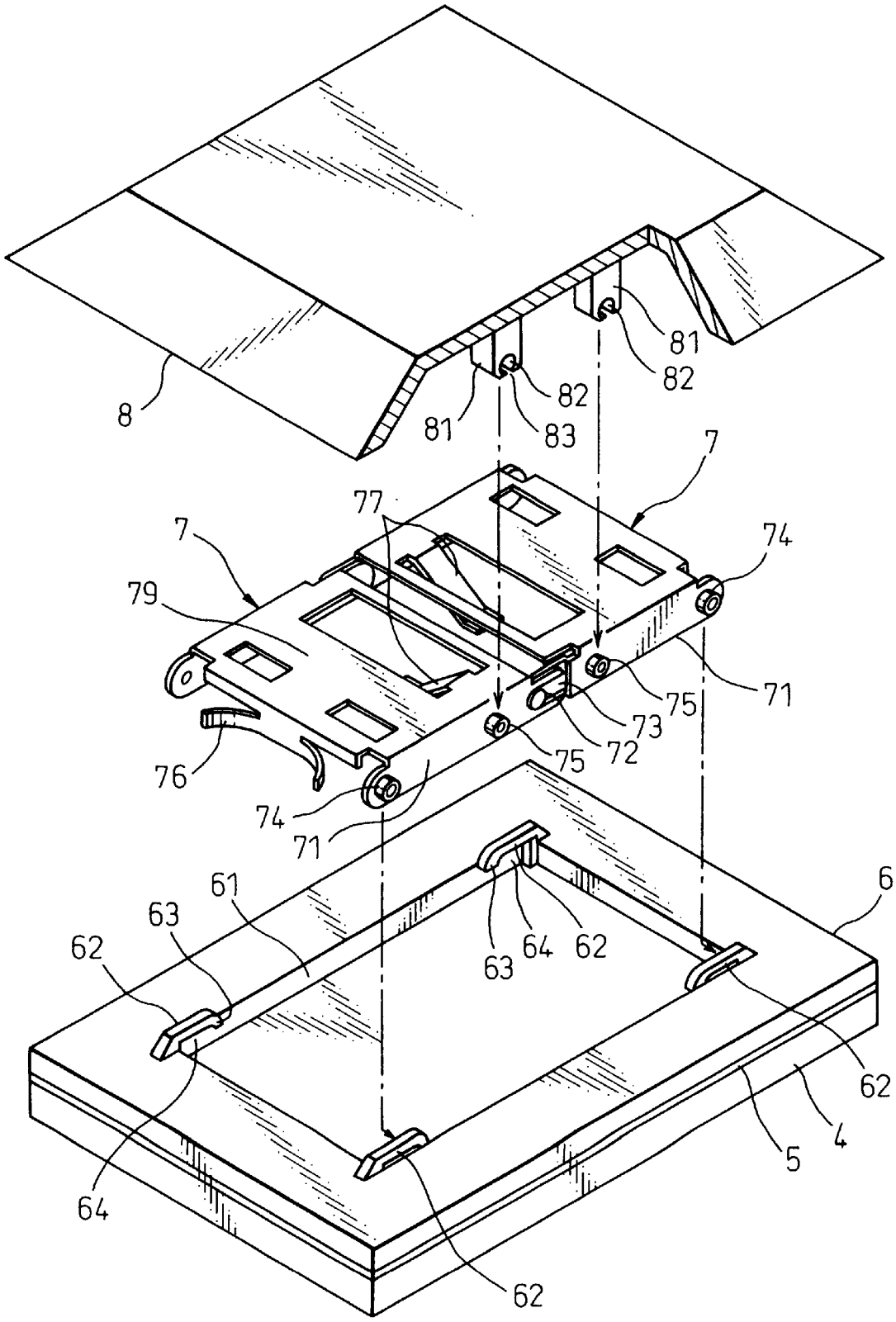
FIG. 3 is an exploded perspective view showing a first embodiment of a key switch according to the present invention.
Figure 4A:
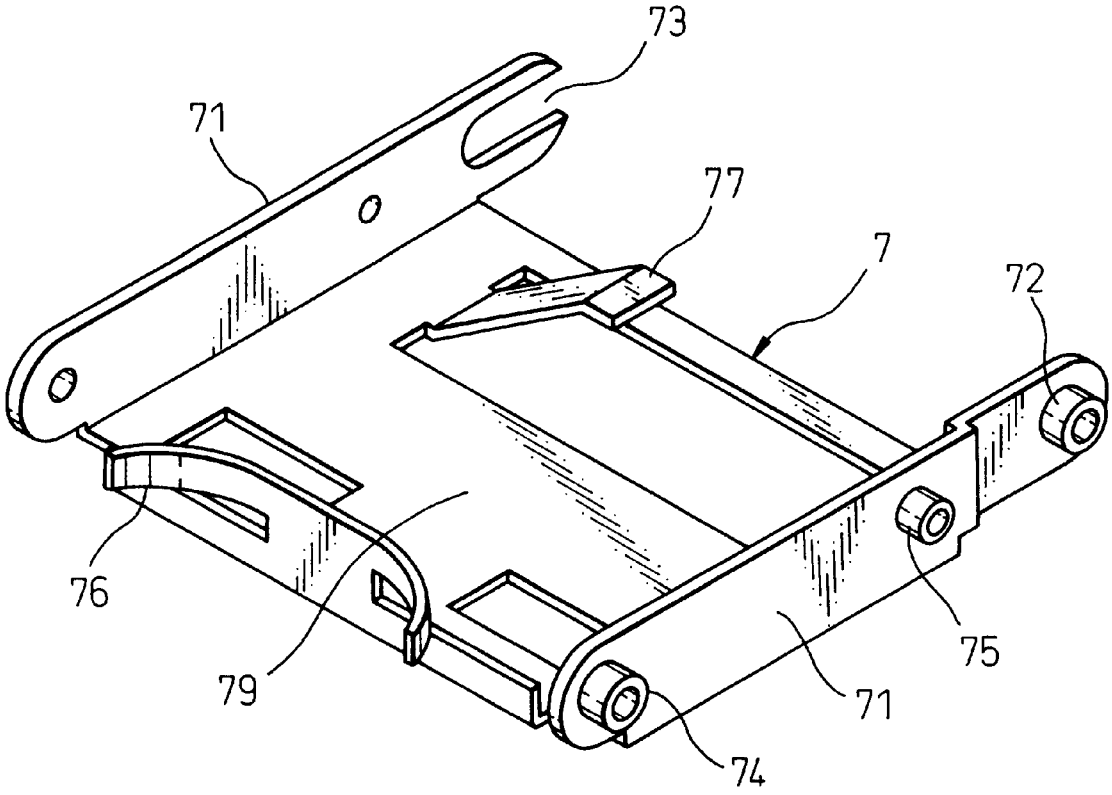
FIG. 4A is a perspective view of a link member in an overturned position, which is used in the key switch of FIG. 3.
Figure 4B:
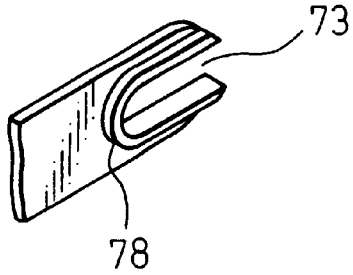
FIG. 4B is a perspective view of a part of the link member shown in FIG. 4A.
Figure 5:
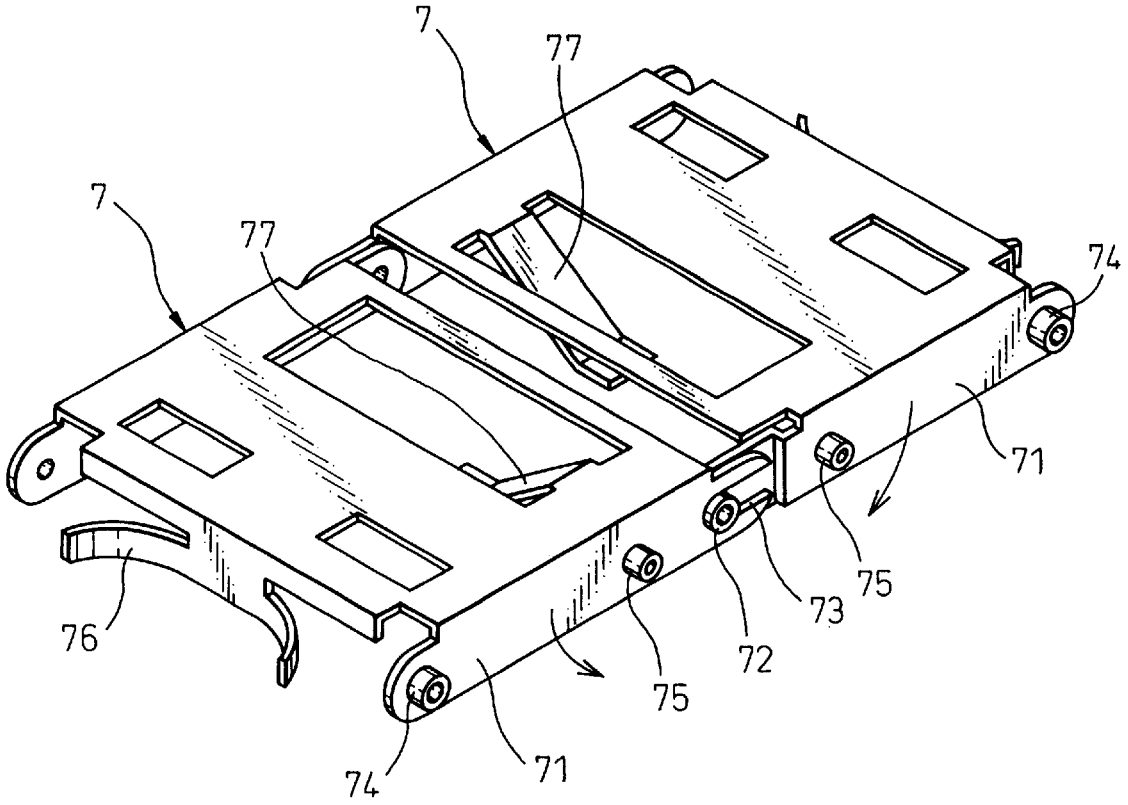
FIG. 5 is a perspective view of link members in an interconnected state, which are used in the key switch of FIG. 3.

Referring now to the drawings, in which the same or similar components are denoted by common reference numerals, FIG. 3 shows a key switch according to a first embodiment of the present invention in an exploded perspective view, FIGS. 4A and 4B show a link member used in the key switch, FIG. 5 shows interconnected link members in the key switch, FIGS. 6A, 6B, 7A and 7B show the key switch in assembled, non-operated and operated states.

The key switch of this embodiment includes a key top 8 adapted to be keyed or pushed down by an operator's finger, a base 6 disposed beneath the key top 8, a pair of link members 7 for supporting the key top 8 above the base 6 and directing or guiding the key top 8 in the vertical or up-and-down direction, a membrane switch 5 arranged beneath the base 6, and a support panel 4 disposed beneath the membrane switch 5 to hold it between the base 6 and the support panel 4. This key switch does not include a dome-shaped elastic actuating member of rubber material.

Each of the link members 7 has a generally U-shaped cross section, and includes a pair of opposed, parallel side walls 71 joined perpendicularly to a main plate portion 79 of the link member 7. The side walls 71 are provided at one longitudinal ends thereof with slide shafts 74 coaxially arranged with each other, and at the halfway points thereof with pivot shafts 75 coaxially arranged with each other, both of the slide and pivot shafts 74, 75 axially projecting from the outside surfaces of the respective side walls 71. The pivot shafts 75 are adapted to be pivotably engaged with the key top 8, as described later, to define a pivot axis of each link member 7.

First side wall 71 of each link member 7 is also provided at another longitudinal end thereof with a joint shaft 72 which axially projects from the outside surface of the first side wall 71 generally in parallel to the pivot axis of the link member 7. Second side wall 71 of each link member 7 is also provided, at another corresponding longitudinal end thereof, with a U-shaped joint slot 73 which has such a dimension as to permit the joint shaft 72 to be slidably and pivotably received therein. The joint slot 73 is formed to open at the outer peripheral edge of the second side wall 71.

The link members 7 have shapes and dimensions identical to each other, and are assembled with each other in such a manner that the joint shafts 72 of the first side walls 71 of respective link members 7 confront the joint slots 73 of the second side walls 71 of respective link members 7. More specifically, the link members 7 are interconnected with each other by slidable and pivotable interengagements or interfits between the joint shafts 72 of the first side walls 71 of respective link members 7 and the joint slots 73 of the second side walls 71 of respective link members 7. It should be noted that, since the joint slots 73 are opened at the peripheral edges of the second side walls 71, the joint shafts 72 can be readily inserted into the joint slots 73, and thus the link members 7 can be readily assembled together.

The base 6 is provided with a center opening 61 into which the pair of interconnected link members 7 can be inserted in a flat position, and with two pairs of slide supports 62 arranged along two, opposed inner edges defining the center opening 61 and partially projecting above the center opening 61. Each of the slide supports 62 is provided at the end thereof with a stopper 63, and defines a bearing slot 64 between the membrane switch 5 and the slide support 62. The slide shafts 74 formed at the ends of the side walls 71 of the respective link members 7 are slidably fitted or received in the bearing slots 64 of the respective slide supports 62 (see FIG. 7A). The stopper 63 of each slide support 62 acts to prevent each slide shaft 74 falling-out from the bearing slot 64.

The key top 8 is provided at an inner surface thereof with two pairs of pivot supports 81 (only two pivot supports 81 are shown), each of which includes a bearing hole 82 and a slit 83 communicating with the bearing hole 82. The pivot supports 81 are located in positions where the respective pivot shafts 75 of the interconnected link members 7 can be fitted in the bearing holes 82 of the respective pivot supports 81. More specifically, the pivot shafts 75 formed at the intermediates of the side walls 71 of the respective link members 7 are pivotably fitted or received in the bearing holes 82 of the respective pivot supports 81 (see FIG. 7A), in a snap-fit manner through the respective slits 83.

In this manner, the link members 7 arranged between the base 6 and the key top 8 are interlocked to each other through the interconnection between the joint shafts 72 and the joint slots 73 in such a manner as to be synchronously pivotable about the pivot shafts 75 held in the pivot supports 81 on the key top 8. In this structure, the key top 8 is permitted to be subjected to a parallel displacement in a substantially vertical direction on the base 6, while keeping a predetermined posture of the key top 8. Also, it is possible to reduce the entire height of the key switch, while maintaining a predetermined amount of the stroke of the key switch.

Each link member 7 of the key switch of the first embodiment further includes a plate spring 76 disposed between the base 6 and the link member 7 so as to act as biasing means for elastically urging upward the key top 8 away from the base 6. In the illustrated embodiment, the plate spring 76 is securely joined to the main plate portion 79 and arranged between the opposed side walls 71 at a position near the common axis of the sliding shafts 74. The free end of the plate spring 76 is adapted to be abutted to one inner edge defining the center opening 61 of the base 6. The plate spring 76 acts as a compression spring between the inner edge of the base 6 and the link member 7.

Each link member 7 of the key switch of the first embodiment yet further includes an actuating arm 77 which acts as actuating means for selectively opening and closing the membrane switch 5 in connection with or corresponding to the vertical or up-and-down movement of the key top 8. In the illustrated embodiment, the actuating arm 77 is joined to the main plate portion 79 and arranged between the opposed side walls 71 at a position near the common axis of the pivot shafts 75. The free end of the actuating arm 77 is adapted to be abutted to the upper surface of the membrane switch 5.

It is preferred that each link member 7 is made from a metal plate through a stamping and bending process. In this case, the above-mentioned various parts, i.e., the side walls 71, the plate spring 76, the actuating arm 77 and the main plate portion 79, of the link member 7 are advantageously integrally joined with each other. Also, in this case, the joint shafts 72, the sliding shafts 74 and the pivot shafts 75 of the link member 7 can be integrally formed with the side walls 71 through a burring process. In this burring process, the metal plate is provided at predetermined positions with through holes, and peripheral edges defining the through holes are deformed by a die and a punch into the cylindrical shape of the shafts.

If the link member 7 is made from a metal plate, sufficient strength can be provided to the end portion of the side wall 71 defining the joint slot 73. Optionally, a U-shaped rib 78 may be formed along the peripheral edge of the joint slot 73, to further improve the mechanical strength of the end portion of the side wall 71 (see FIG. 4B). Of course, the link member 7 may be made of other materials, such as resin. In this case, the plate spring 76 made of metal may be integrally joined to the resinous link member 7 through an insert molding process.

It is advantageous that the link members 7 have shapes and dimensions identical to each other, from the viewpoint of the production cost of the key switch. However, the desired operational properties of the key switch can be obtained only if the plate spring 76 as well as the actuating arm 77 are provided at least one of the link members 7, due to the interlocking structure of the link members 7.

The membrane switch 5 is constructed from two flexible printed circuit boards 52 stacked one on the other with a spacer 51 interposed therebetween, the conductive patterns of the circuit boards 52 being arranged opposite to each other. A switching element 53 for defining an electric circuit between the circuit boards 52 is formed from a pair of conductive contacts which are arranged on the circuit boards 52 to be opposed to each other through a gap. The membrane switch 5 is stationarily supported on the support panel 4 under the base 6, and locates the switching element 53 at a predetermined position in the center opening 61 of the base 6 so as to be located beneath the free end of the actuating arm 77 of only one of the link members 7 (FIGS. 6A, 6B).

Figure 6A:
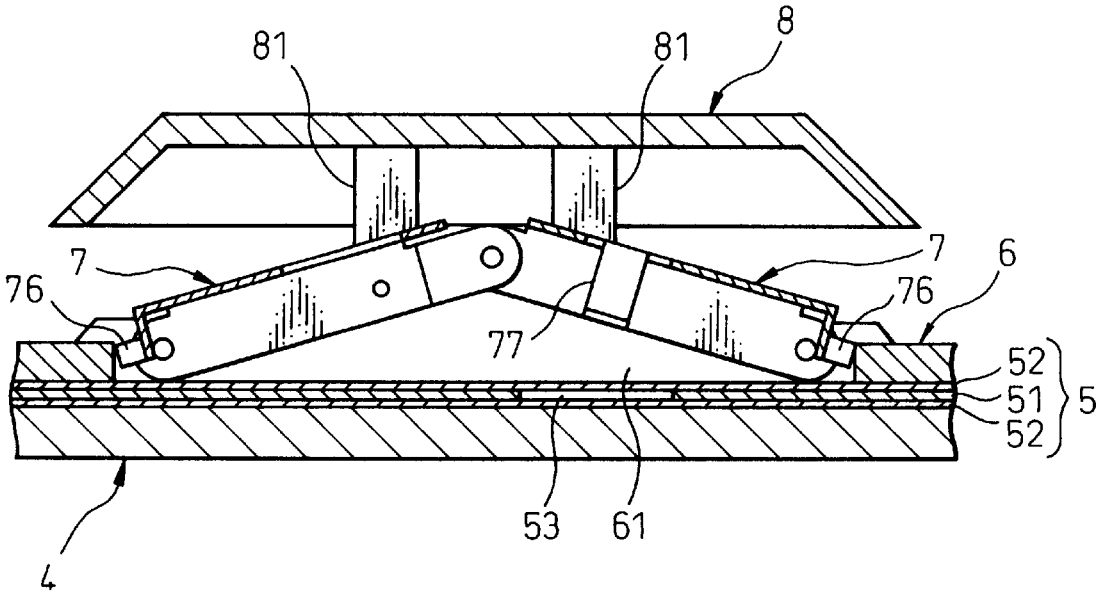
FIGS. 6A and 6B are sectional views showing the key switch of FIG. 3 in assembled, non-operated and operated states, respectively.
Figure 6B:
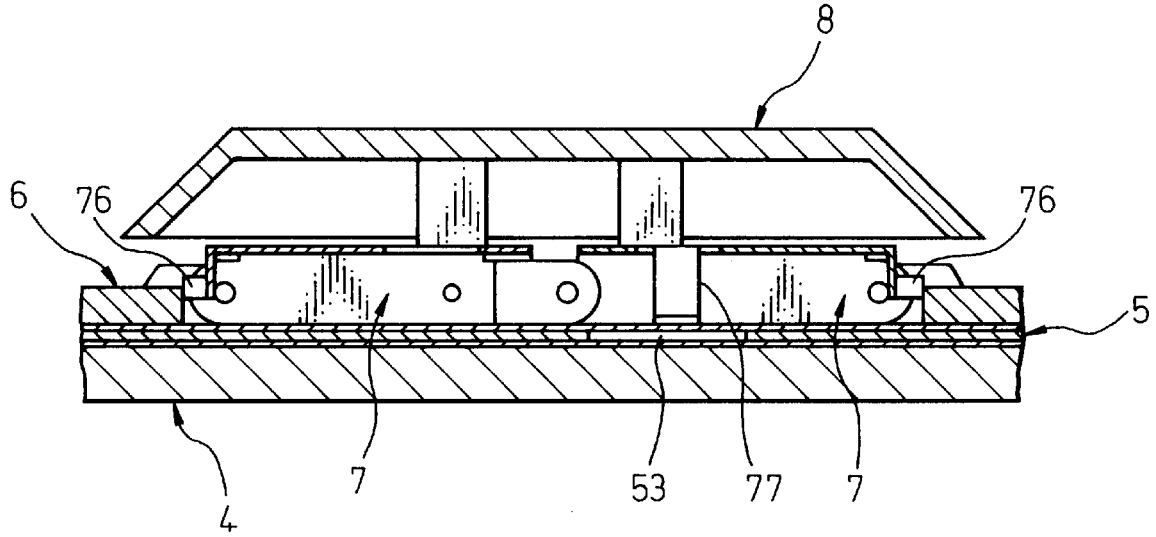
Figure 7A:
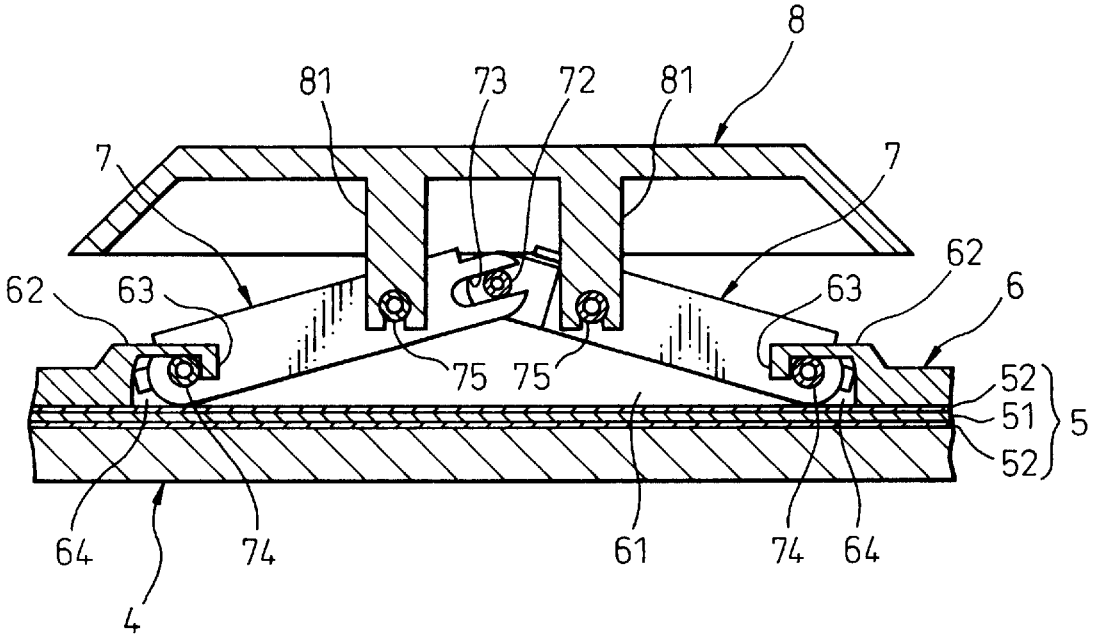
FIGS. 7A and 7B are the other sectional views showing the key switch of FIG. 3 in the assembled, non-operated and operated states, respectively.
Figure 7B:
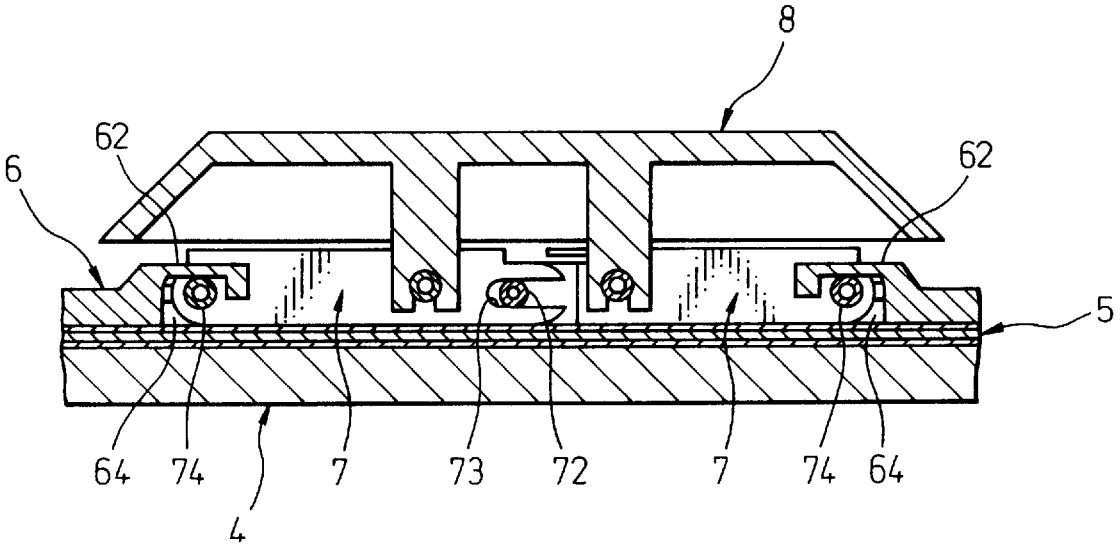

In the above-mentioned structure, when no external force is applied to the key top 8, the plate springs 76 formed on the link members 7 urge or bias the key top 8, through the interconnected link members 7, toward an initial position vertically upwardly away from the base 6, and hold the key top 8 in the initial position (see FIGS. 6A and 7A). During this state, the slide shafts 74 of each link member 7 are biased along the bearing slots 64 of the respective slide supports 62, and are located near the stoppers 63 of the slide supports 62. Also, the membrane switch 5 is kept in a condition where the switching element 53 is opened.

When the key top 8 is pushed downward by a key-entry operation, the plate springs 76 are elastically deformed while exerting biasing or elastic restoring force to the key top 8 in an upward direction through the interconnected link members 7. During this operation, the link members 7 are pivoted in an interlocked manner, and the slide shafts 74 of each link member 7 are shifted in the bearing slots 64 of the slide supports 62 to increase the distance from the slide shafts 74 of the counterpart link member 7. Then, the interconnected link members 7 are received in the center opening 61 of the base 6 in a generally flat assembled state (see FIGS. 6B and 7B). Also, during this operation, the free ends of the actuating arms 77 of both link members 7 enter into the center opening 61 of the base 6 and are abutted to the membrane switch 5. Then, only one of the actuating arms 77 of the link members 7 pushes the switching element 53 to close it due to an elastic pushing force applied through this actuating arm 77.

When downward pushing force applied to the key top 8 is released, the plate springs 76 are elastically restored, so as to return or push-up the key top 8 to the initial position through the interconnected link members 7. During this operation, the link members 7 are pivoted in a reverse direction in an interlocked manner, and the slide shafts 74 of each link member 7 are shifted in the bearing slots 64 of the slide supports 62 to reduce the distance from the slide shafts 74 of the counterpart link member 7. Also, during this operation, the actuating arms 77 of the link members 7 clear from the membrane switch 5 to open the switching element 53.

According to the key switch of the first embodiment, the link members 7 include a relatively simple interconnecting structure established by the joint shafts 72 and the joint slots 73, in comparison with the intermeshed structure of the gear-link members used in the conventional key switch. Therefore, the joint shaft 72 and the joint slot 73 of each link member 7 are relatively easily formed at the corresponding ends of the respective side walls 71, even if the size of the side walls 71 is reduced to a certain degree. Consequently, in comparison with the gear-link member of the conventional key switch, the dimension of or especially the thickness of each link member 7 can be further reduced while maintaining the smooth rotation of the interconnected link members 7.

Also, because the key switch of the first embodiment adopts the actuating arm 77 formed on the link member 7 as actuating means for selectively opening and closing the membrane switch 5, instead of the dome-shaped elastic actuating member of rubber material used in the conventional key switch, the height of the key switch can be significantly reduced without deteriorating the operational properties of the key switch. As a result, the key switch of the first embodiment can contribute to a significant reduction of the height or thickness of a keyboard.

Figure 8:
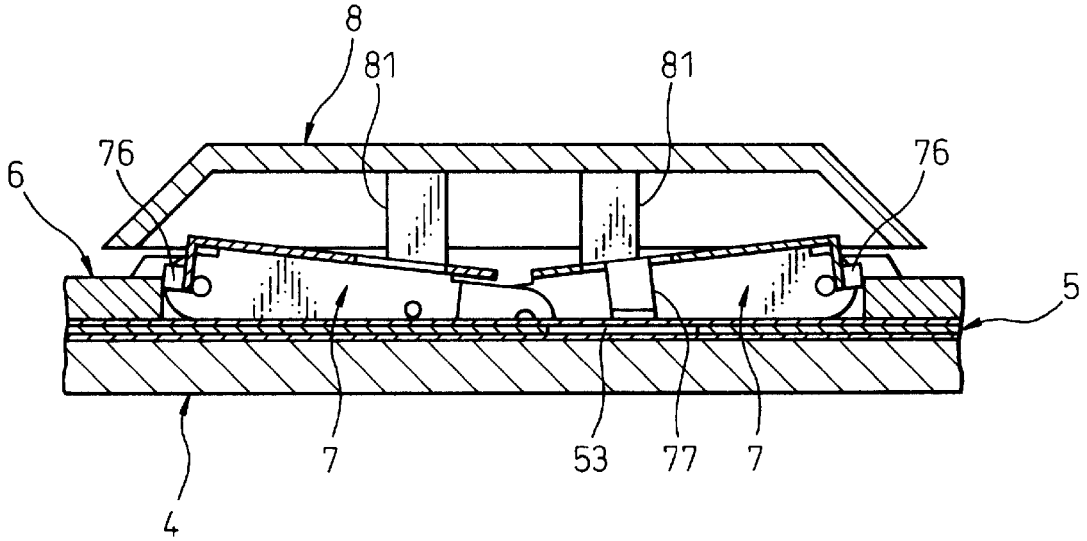
FIG. 8 is a sectional view showing the modification of the key switch of FIG. 3 in assembled, operated state.
Figure 9:
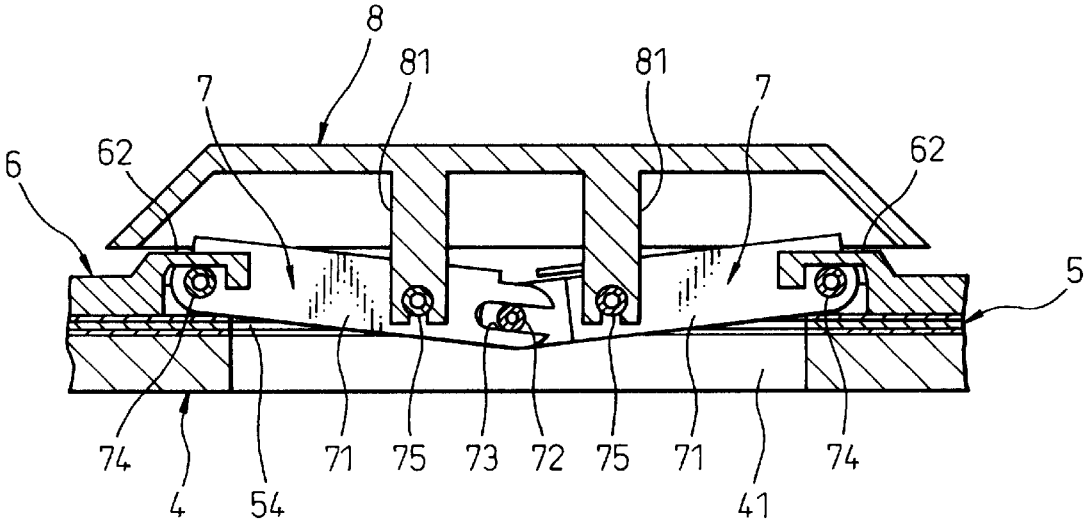
FIG. 9 is another sectional view showing the modification of the key switch of FIG. 3 in the assembled, operated state.

The interconnecting structure established by the joint shafts 72 and the joint slots 73 of the link members 7 allows a relatively wide angle rotation of the interconnected link members 7, in comparison with the intermeshed structure established by one or two teeth of the gear-link members in the conventional key switch. To effectively utilize this interconnecting properties of the link members 7, it is advantageous to form openings 41 and 54 in the support panel 4 and the membrane switch 5, respectively, at positions where the side walls 71 of both link members 7 are at least partially and snugly received in the openings 41, 54 (see FIGS. 8 and 9).

According to this modification, it is possible to lower the pushed-down position of the key top 8 when the membrane switch 5 is closed, and also to set the initial position of the key top 8 at a lower level vertically upwardly away from the base 6. Consequently, the height of the key switch, upon both the non-operated and operated conditions thereof, can be further reduced while maintaining the stroke of the key switch at a predetermined distance to ensure good and stable operational properties thereof.

Figure 10:
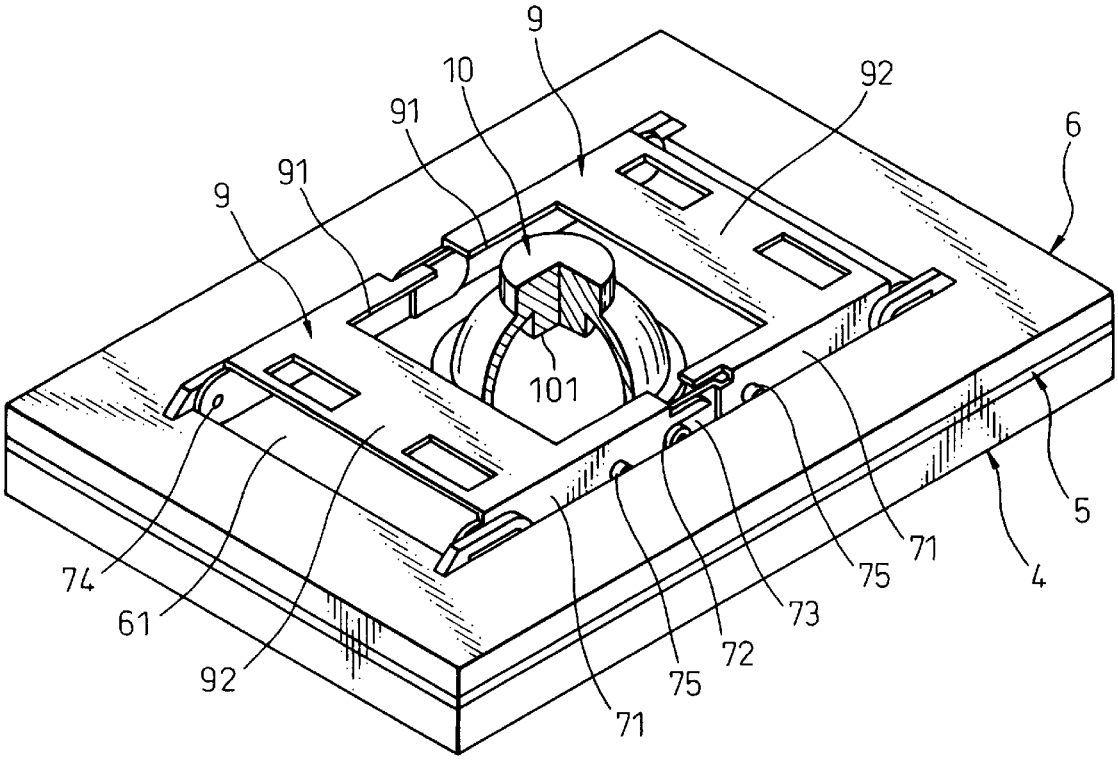
FIG. 10 is a partially cut-out, perspective view showing a second embodiment of a key switch according to the present invention, wherein a key top is omitted for the purpose of visibility.

FIG. 10 shows a key switch according to a second embodiment of the present invention, wherein a key top is omitted for the purpose of visibility. The key switch of this embodiment includes a support panel 4, a membrane switch 5, a base 6 and a key top (not shown), which have the same structure as the support panel 4, the membrane switch 5, the base 6 and the key top 8 of the first embodiment and, therefore, a detailed description of these components is not repeated.

The key switch of the second embodiment further includes a pair of link members 9 for supporting the key top above the base 6 and directing or guiding the key top in the vertical or up-and-down direction, and a dome-shaped elastic actuating member 10 of rubber material arranged between the membrane switch 5 and the key top.

Each of the link members 9 has a generally identical structure as the link member 7 of the first embodiment, except that the link member 9 does not include the plate spring 76 and the actuating arm 77 of the link member 7. Also, the link member 9 is provided in a main plate portion 92 thereof with a generally U-shaped cut-out edge 91. When the link members 9 are assembled or interconnected under the engagement of the joint shafts 72 with the joint slots 73, the cut-out edges 91 of both link members 9 coact to define an opening therebetween, which allows the dome-shaped elastic actuating member 10 to be arranged in the center opening 61 of the base 6 into which the pair of interconnected link members 9 are also inserted in a flat position.

It is preferred that each link member 9 is made from a metal plate through a stamping and bending process. The metal link member 9 possesses various effects as mentioned in connection with the metal link member 7 of the first embodiment.

The dome-shaped elastic actuating member 10 acts as biasing means for elastically urging upward the key top away from the base 6, and also as actuating means for selectively opening and closing the membrane switch 5 in connection with the vertical or up-and-down movement of the key top.

In the above-mentioned structure, when no external force is applied to the key top, the elastic actuating member 10 urges or biases the key top toward an initial position vertically upwardly away from the base 6, and hold the key top in the initial position. Also, the membrane switch 5 is kept in a condition where the switching element is opened.

When the key top is pushed downward by a key-entry operation, the elastic actuating member 10 is elastically deformed while exerting a biasing or elastic restoring force on the key top in an upward direction. During this operation, the link members 9 are pivoted in an interlocked manner, similar to the link members 7 of the first embodiment, and then received in the center opening 61 of the base 6 in a generally flat assembled state. Also, during this operation, an inner bulge 101 formed at the top end of the elastic actuating member 10 is abutted to the membrane switch 5 to close the switching element thereof due to an elastic pushing force applied through the actuating member 10.

When a downward pushing force applied to the key top is released, the elastic actuating member 10 is elastically restored, so as to return or push-up the key top to the initial position. During this operation, the link members 9 are pivoted in a reverse direction in an interlocked manner, and the inner bulge 101 of the actuating member 10 leaves the membrane switch 5 to allow the switching element to open.

According to the key switch of the second embodiment, the dimension of, or especially the thickness of, each link member 9 can be further diminished while maintaining the smooth rotation of the interconnected link members 9, due to the relatively simple interconnecting structure of the link members 9, in the same manner as the link members 7 of the first embodiment. Therefore, the height of the key switch can be reduced without deteriorating the operational properties of the key switch. As a result, the key switch of the second embodiment can contribute to a significant reduction in the height or thickness of a keyboard.

While the invention has been particularly shown and described with reference to preferred embodiments thereof, it will be understood by those skilled in the art that various changes and modifications may be made without departing from the spirit and scope of the following claims.

What is claimed is:

1. A key switch comprising:

a base;

a key top arranged above said base;

a pair of link members interconnected with each other, each of said link members including opposed first and second side walls, slide portions formed at one ends of said first and second side walls to be slidably engaged with said base, pivot portions formed at halfway points of said first and second side walls to be pivotably engaged with said key top to define a pivot axis of each link member, a joint shaft provided at another end of said first side wall to project from said first side wall, and a joint slot provided at another end of said second side wall to permit said joint shaft to be slidably and pivotably received in said joint slot of counterpart link member, said link members acting to support said key top above said base and to direct said key top in a vertical direction;

a biasing member for elastically urging said key top vertically away from said base; and a switching mechanism for selectively opening and closing an electric circuit in connection with a vertical movement of said key top.

2. The key switch of claim 1, wherein said joint shaft provided to said first side wall of said each link member extends generally in parallel with said pivot axis, and wherein said joint slot provided to said second side wall opens at a peripheral edge of said second side wall.

3. The key switch of claim 1, wherein said biasing member is a compression spring disposed between said base and at least one of said link members.

4. The key switch of claim 3, wherein said compression spring is a plate spring securely joined to at least one of said link members at a position near said sliding portions, a free end of said plate spring being abutted to said base.

5. The key switch of claim 1, wherein said switching mechanism comprises a membrane switch arranged beneath said base and adjacent to said link members through an opening formed in said base, and an actuating member for pushing said membrane switch to close said electric circuit.

6. The key switch of claim 5, wherein said actuating member is an actuating arm formed on at least one of said link members.

7. The key switch of claim 5, wherein said actuating member is a dome-shaped rubber material arranged between said membrane switch and said key top through an opening defined between interconnected link members, said dome-shaped rubber material also acting as said biasing member.

8. The key switch of claim 5, wherein said membrane switch is provided with openings at positions where said side walls of the link members are received in said openings.

9. The key switch of claim 1, wherein each of said link members is made from a metal plate.

10. The key switch of claim 1, wherein each of said link members is provided with a rib formed along a peripheral edge of said joint slot.

* * * * *